United States Patent [19]

D'Andrade

[11] Patent Number: 4,993,932

[45] Date of Patent: Feb. 19, 1991

[54] CLAY DOUGH TOY EXTRUDER

[76] Inventor: Bruce M. D'Andrade, 3 Ten Eyck Rd., Whitehouse Station, N.J. 08889

[21] Appl. No.: 496,649

[22] Filed: Mar. 21, 1990

[51] Int. Cl.[5] ..... B29C 47/00

[52] U.S. Cl. ..... 425/154; 425/207; 425/376.1; 425/381; 425/DIG. 57

[58] Field of Search ..... 446/144, 72, 86, 424; 425/DIG. 57, 190, 483, 154, 381

[56] References Cited

U.S. PATENT DOCUMENTS

| | | | |
|---|---|---|---|
| 2,578,105 | 12/1951 | Taylor | 425/DIG. 57 |
| 3,063,109 | 11/1962 | Rapaport | 425/DIG. 57 |
| 3,574,897 | 4/1971 | Citron et al. | 425/129.1 |
| 3,590,749 | 7/1971 | Burns et al. | 425/DIG. 57 |
| 3,685,936 | 8/1972 | Meth et al. | 425/DIG. 57 |
| 3,985,273 | 10/1976 | Davis, Jr. | 222/326 |
| 4,496,510 | 1/1985 | Hanson et al. | 425/376.1 |
| 4,583,934 | 4/1986 | Hata et al. | 425/376.1 |
| 4,623,319 | 11/1986 | Zaruba et al. | 425/DIG. 57 |
| 4,693,611 | 9/1987 | Verkler | 425/206 |
| 4,815,961 | 3/1989 | Kindred | 425/DIG. 57 |

*Primary Examiner*—Jay H. Woo
*Assistant Examiner*—Robert B. Davis
*Attorney, Agent, or Firm*—Kenneth P. Glynn

[57] ABSTRACT

The present invention is directed to a toy molder/extruder which is used for cold molding and/or cold extruding of clay dough with the use of toy molds and toy dies. This toy has a main housing with a base, an upright middle section and a top. A pinion gear is rotatably located at the top of the housing and a crank wheel and handle is connected to the pinion gear to enable the user to rotate the pinion gear. A ram piston with a rack gear is attached to the main housing with the ram piston being connected to the top of the housing in a vertically movable fashion, so as to engage the rack gear and the pinion gear with on another. The toy also has a compression chamber with an open top which is connected to the housing and located below the ram piston. It has a cross-sectional dimension adequate to allow ram insertion of the ram piston and has a tapered bottom with an outlet orifice substantially smaller than the compression chamber's open top. The toy also includes a clamping means connected to the housing and located below the compression chamber so as to hold a mold or die for receiving clay dough by ram action compression-injection.

7 Claims, 3 Drawing Sheets

CLAY DOUGH TOY EXTRUDER

BACKGROUND OF THE INVENTION

1. Field of the Invention

The present invention is directed to a toy molder/extruder and more specifically for such a toy which is used to injection mold clay dough into toy molds to form playful three dimensional objects and for continuous extrusion of clay dough through dies to form playful cross-sectional designs for children. Thus, the present invention is directed to a toy which functions in such a way as to add a new dimension to molding of clay dough for children and to also add the feature of extrusion capabilities.

Clay dough is a type of formable and moldable material which is sold for children along with molding kits and free form use. Kenner Products Company of Cincinnati, Ohio markets PLAY DOUGH(®) and this product as well as equivalent materials sold by competitors are well known and recognized in the field of toy products for children PLAY DOUGH(®) is a registered trademark of Kenner Products Company). Various products employing PLAY DOUGH(®) include cookie cutter type toys as well as insets, compression molds and extrusions. However, it is not believed that any toy such as the present invention for using a toy tool to mold or extrude has been created for playful purposes.

Numerous toy tools have been developed over the years and these are exemplified by the toy press described in U.S. Pat. No. 1,315,746 issued to Theodore Smolinsky and the toy hammer of U.S. Pat. No. 1,359,927, also issued to Theodore Smolinsky. Likewise, U.S. Pat. No. 3,164,177 issued to Carl Merl describes a toy convertible power shop with simulated power tool functions. U.S. Pat. No. 2,760,302 issued to Lewis Cheskin describes simulated extrusions or pop-out figures from a tube. While all of these patents relate in a manner to toys which involve simulated tools and/or creation of forms of playful designs, none teach or suggest the advantageous toy molder/extruder of the present invention.

SUMMARY OF THE INVENTION

The present invention is directed to a toy molder/extruder which is used for cold molding and/or cold extruding of clay dough with the use of toy molds and toy dies. This toy has a main housing with a base, an upright middle section and a top. A pinion gear is rotatably located at the top of the housing and a crank wheel and handle is connected to the pinion gear to enable the user to rotate the pinion gear. A ram piston with a rack gear is attached to the main housing with the ram piston being connected to the top of the housing in a vertically movable fashion, so as to engage the rack gear and the pinion gear with one another. The toy also has a compression chamber with an open top which is connected to the housing and located below the ram piston. It has a cross-sectional dimension adequate to allow ram insertion of the ram piston and has a tapered bottom with an outlet orifice substantially smaller than the compression chamber's open top. The toy also includes a clamping means connected to the housing and located below the compression chamber so as to hold a mold or die for receiving clay dough by ram action compression-injection. Thus, a child would insert clay dough into the top of the compression chamber, rotate the crank wheel handle, thereby compressing and forcing the clay dough from the compression chamber into a mold or die and, as a result, create figurines or extrusions or the like for play.

BRIEF DESCRIPTION OF THE DRAWINGS

The present invention as described in the specification herein will be more fully understood when taken in conjunction with the drawings which are appended hereto. These drawings are as follows.

DETAILED DESCRIPTION OF THE PRESENT INVENTION

PLAY DOUGH(®) is a very popular form of entertainment and play for children. It is used for free sculpturing as well as for rolling and cookie cutting. It is also used with various adjunct toys to make pressed molds and even formed molds. For example, there are now toys on the market in which the PLAY DOUGH(®) is placed in a cavity and a hinged top is then pressed down to the base of the cavity forcing the PLAY DOUGH(®) into a particular three dimensional figure or other molded shape.

The present invention is developed to add a totally new dimension for children to the use of clay dough. Thus, a child will have the enjoyment of utilizing different cavities, i.e. molds and dies, in conjunction with the molder/extruder toy of the present invention and will also enjoy operating the device much like one would operate some sort of tool in a shop. The toy of the present invention, therefore, may have tool like features i.e. may be made of gray plastic and have mechanical external skeletal support to look very masculine, or it may be of smooth, bright colored toy to appear more like a kitchen device or a toy to appeal to younger children. In any event, the present invention enables a child to logically and sequentially produce different types of figurines with a more pleasing result due to the injection-compression molding and extruding technique that results from use of the present invention toy.

Figure 1:
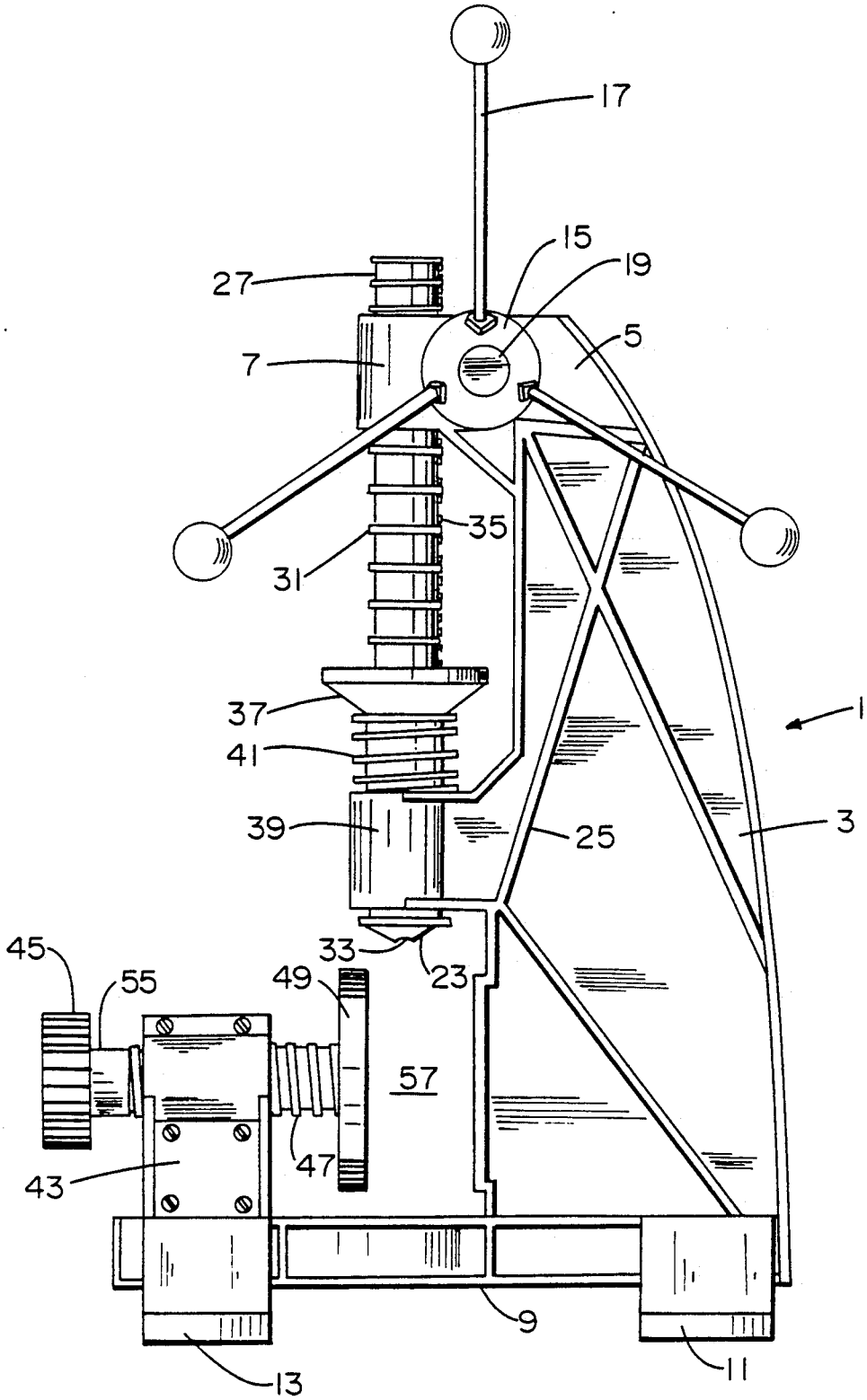
FIG. 1 shows a side view of a present invention molder/extruder toy.

Referring now to FIG. 1, there is shown a present invention molder/extruder toy 1 which includes a main housing 3 which has a middle section 25, a top 5 and a base 9. In this particular embodiment, top 5 has an extension with a vertical opening therein which top extension 7 also houses a crank wheel 15 on shaft 19 with a three rod handle arrangement typified by handle 17. A pinion gear (shown below in FIG. 2) is rotatably located within top 5 of main housing 3, is attached to shaft 19 and crank wheel 15 and is operated by the rotation of handle 17. The pinion gear is set so as to engage in rack gear 35 located on ram piston 27. In this embodiment, ram piston 27 has the rack gear located vertically along its back and ram piston 27 movably sits within the vertical opening of top extension 7.

A compression chamber 37 has an opening at its top and is connected to main housing 3 at middle section 25 which includes middle section extension 39 which is basically a support ring for compression chamber 37. Compression chamber 37 has an open top which has a cross-sectional dimension adequate to allow ram insertion of the ram piston 27, as shown. Compression chamber 37 also has a tapered bottom 23 with an outlet orifice 33 which is substantially smaller than the open top of compression chamber 37. While compression chamber 37 may be stationary, in this preferred embodiment it is floating and biased in an upward position via spring 41 as shown. Also, horizontal ridges 31 are located about ram piston 27 so as to enhance its functionality and so as to avoid cleaning and sticking problems which might otherwise occur. Base 9 in this embodiment includes foot rests 11 and 13, although base 9 could be unistructural and have no independent footing. Attached to base 9 via upright 43 which includes a horizontal opening, is clamping means 55 which has a rotatable handle 45 and threads 47 with support 49. An open area 57 is provided to receive a mold or die and by rotating handle 45 in conjunction with threads 47, support 49 will move towards main housing 3 so as to clamp a die or mold as desired.

When handle 17 is rotated clockwise, the rack and pinion gearing causes ram piston 27 to rise up out of compression chamber 37. The user then clamps a mold or die into the open area 57 by rotating handle 45. The toy 1 is then utilized as described more fully in conjunction with FIG. 4 below. In this particular embodiment, handle 17 is arranged with the other handles in a triangular fashion and, since crank wheel 15 is spherical, the handles form three sides of a tetrahedron. However, the handle could be a single handle or a double handle or even a rotational wheel type handle. Additionally, the clamping means could simply be a spring loaded flat structure which the user would pull back or push back to insert or it could be a spring loaded hinged wire or any other clamping means without exceeding the scope of the present invention.

Figure 2:
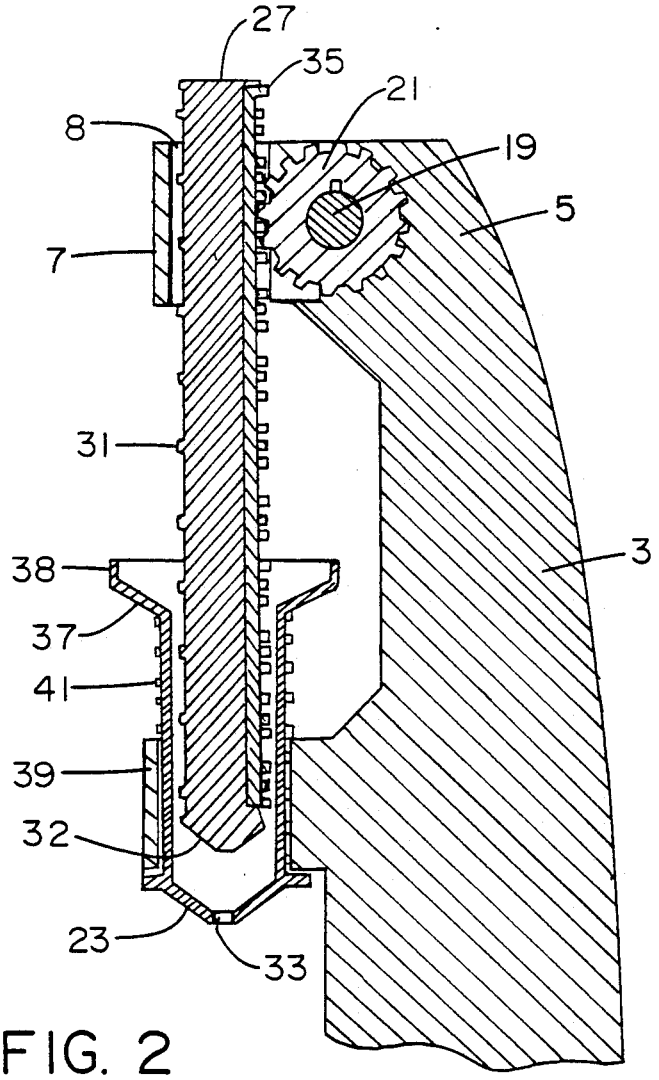
FIG. 2 shows a partial side cut view of the middle and top portions of the present invention toy shown in FIG. 1.

Referring now to FIG. 2, there is shown a partial cut side view of the upper portions of the toy shown in FIG. 1. Thus, main housing 3 is shown with top 5 and top extension 7 showing the vertical opening 8 therein as well as ram piston 27 and rack gear 35. Ram piston 27 has horizontal ridges 31 as discussed above and has a tapered piston head 32, as shown. Pinion gear 21 is shown as being located on shaft 19 and more detail is shown in conjunction with FIG. 3 below. Compression chamber 37 has a wide top 38 as shown as well as tapered bottom 23 and outlet orifice 33. Other like parts are like numbered. It can now be seen that a user will compress clay dough in compression chamber 37 due to the downward force of ram piston 27 and a solid extrusion of clay dough will exit from outlet orifice 33 into a mold or die as desired.

Figure 3:
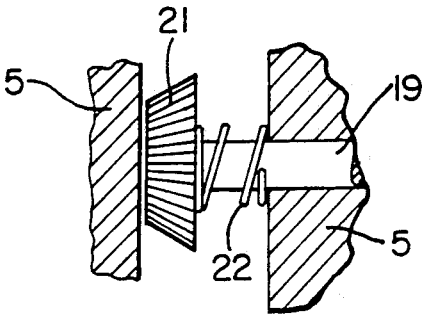
FIG. 3 shows a partial side cut view of a preferred clutch mechanism used in the present invention.

FIG. 3 shows a partial cut front view of top 5 showing pinion gear 21 as being beveled and attached to shaft 19. Spring 22 creates a clutching mechanism in conjunction with the beveled pinion gear 21 such that if excessive force is applied to handle 17, pinion gear 21 will tend to move away from rack gear 37 and a disengaging effect will occur. This safety feature will prevent the child from breaking the device or stripping the gears and will extend the useful life of the toy.

Figure 4:
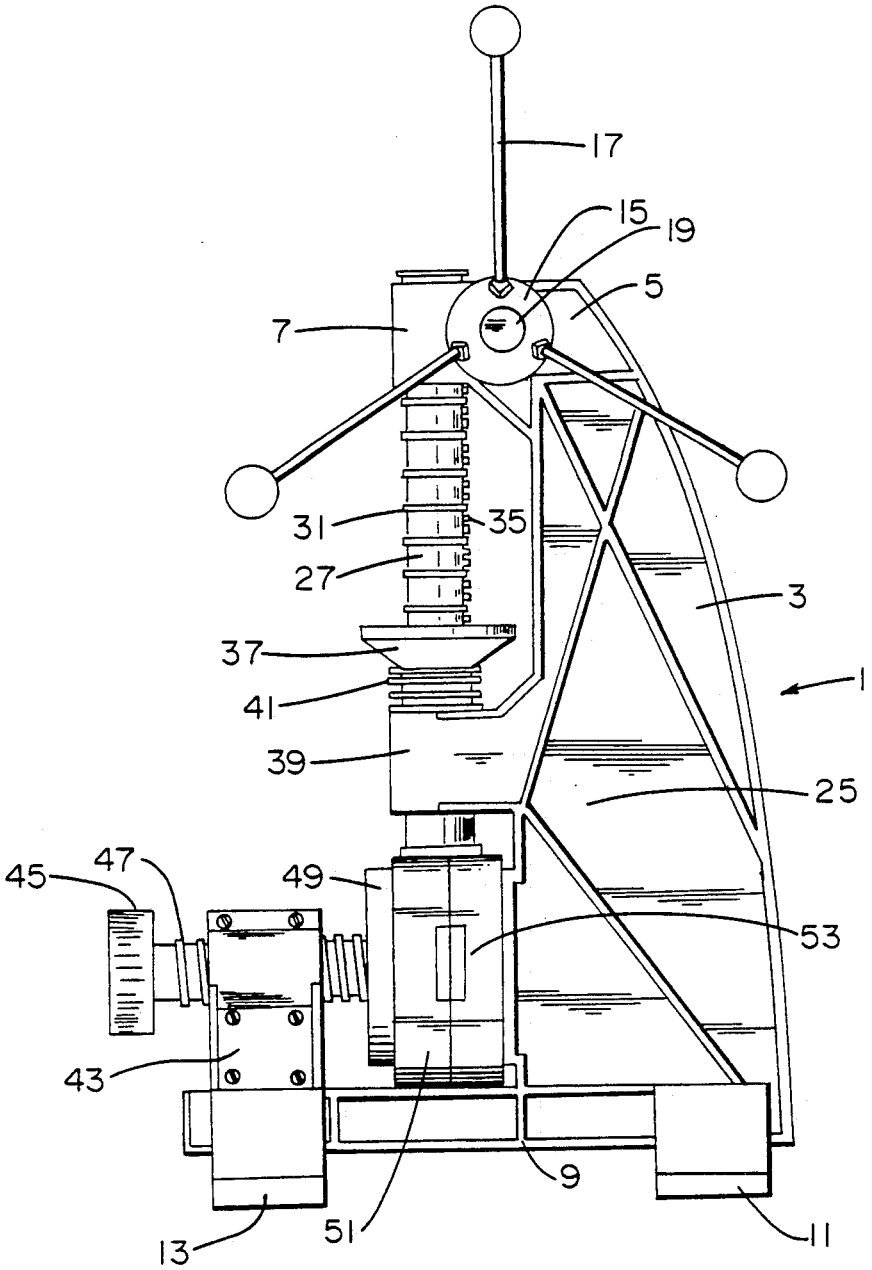
FIG. 4 illustrates the device or toy of FIG. 1 but with a PLAY DOUGH(®) mold locked into position and with compression force being applied; and, FIG. 5 shows an extruder die which may be used with the toy of the present invention.

FIG. 4 shows the toy of FIG. 1 except that handle 17 has been rotated such that ram piston 27 is in the totally down position. In this figure, like parts are like numbered with FIG. 1. However, note that a two part mold having front side 51 and back side 53 has been clamped into position by the rotation of handle 45 in what was previously open area 57 in FIG. 1. Also, the mold has a tapered opening similar to tapered opening 75 shown in FIG. 5 but not shown in this figure whereby the tapered bottom 23 of compression chamber 37 with outlet orifice 33 has been moved downwardly in intimate contact with the opening in the mold. Further, as a result of the compression action, spring 41 has been compressed because of the downward movement of compression chamber 37 and the downward force of ram piston 27. Thus, the compression chamber was initially filled with clay dough as described in conjunction with FIG. 1 above, the mold was then clamped into place and the handle 17 rotated so that both the compression chamber 37 and ram piston 27 moved downwardly so as to effect a very clean and thorough injection of the clay dough into the mold. The child would then remove the mold taking front portion 51 and back portion 53 apart so as to expose a very well cast figurine, play toy or other three dimensional shape.

Figure 5:
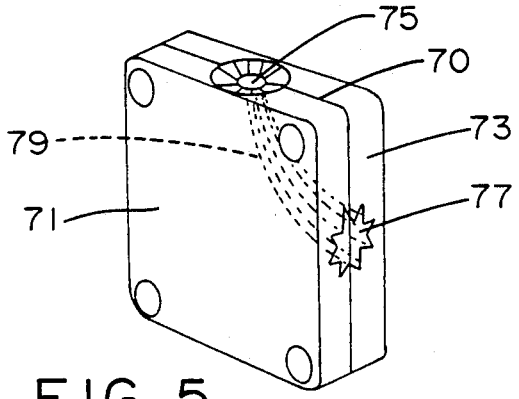

As an alternative to molding or casting, a child may insert an extruding die such as die 70 shown in FIG. 5. Die 70 has a front portion 71 and a back portion 73 which are snapped together and has an inlet orifice 75 which is tapered to receive the tapered bottom 23 of compression chamber 37 (shown above) and has an expanding channel 79 which outlets at 77 in the form of a star. By this mechanism, a child may extrude a length of PLAY DOUGH(®) in the shape of a star. In other words, the extrusion would have a cross-sectional configuration of star 77. While star 77 is shown in FIG. 5, obviously, any type of shape could be used such as a silhouette of a person, a series of small circular openings to create a spaghetti effect, a cookie mold type of shape where the PLAY DOUGH(®) is subsequently sliced at desired, or the like. The child may repeatedly fill the compression chamber with clay dough even though different colors to make a very long extrusion of changing colors. Other variations should now be within the skill of the artisan.

Obviously, numerous modifications and variations of the present invention are possible in light of the above teachings. It is therefore understood that within the scope of the appended claims, the invention may be practiced otherwise than as specifically described herein.

What is claimed is:

1. An extruder toy for cold molding and cold extruding of clay dough with toy molds and dies, which comprises:

(a) a main housing having a base, an upright middle section and a top;

(b) a pinion gear rotatably located at the top of said housing;

(c) a crank wheel and handle connected to said pinion gear to enable a user to rotate said pinion gear;

(d) a ram piston with a rack gear attached thereto, said ram piston being connected to the top of said housing in a vertically movable fashion and so as to engage said rack gear and said pinion gear with one another, said ram piston further having horizontal ridges to enhance the functioning of said toy and decrease sticking of clay dough during use;

(e) a compression chamber having an open top, connected to said housing and located below said ram piston, and having a cross-sectional dimension adequate to allow ram insertion of said ram piston therein, said compression chamber having a tapered bottom with an outlet orifice substantially smaller than said compression chamber open top;

(f) clamping means connected to said housing and located below said compression chamber to hold a mold or die for receiving clay dough therefrom by ram action compression-injection; and, (g) a safety clutch engaged with said pinion gear and said rack gear to permit slipping of said pinion gear relative to said rack gear when excessive force above a predetermined limit is applied.

2. The toy of claim 1 wherein said compression chamber is vertically mounted on said housing with a spring connected thereto for upward bias.

3. The toy of claim 1 wherein said compression chamber has a funnel-like tapered open top.

4. The toy of claim 1 wherein said clamping means is a screw-type flat-walled clamp.

5. The toy of claim 1 wherein said clutch is a spring bias for engagement which permits rotation of said pinion gear without moving said rack gear when said crank wheel is turned with a force in excess of a predetermined limit.

6. The toy of claim 5 wherein said pinion gear is a beveled pinion gear and said safety clutch is a spring bias in a direction coaxial with an axis of rotation of said pinion gear.

7. The toy of claim 1 wherein said ram piston has a downwardly tapered piston head.

* * * * *